US011211200B2

(12) United States Patent
Bhowmik et al.

(10) Patent No.: US 11,211,200 B2
(45) Date of Patent: Dec. 28, 2021

(54) INDUCTIVE COMMUNICATION COIL DESIGN

(71) Applicant: BIOTRONIK SE & CO. KG, Berlin (DE)

(72) Inventors: Siddhartha Bhowmik, Lake Oswego, OR (US); Frederik Sporon-Fiedler, Lake Oswego, OR (US); Daniel Witherspoon, Ridgefield, WA (US)

(73) Assignee: BIOTRONIK Se & Co. KG, Berlin (DE)

( * ) Notice: Subject to any disclaimer, the term of this patent is extended or adjusted under 35 U.S.C. 154(b) by 504 days.

(21) Appl. No.: 16/103,010

(22) Filed: Aug. 14, 2018

(65) Prior Publication Data

US 2019/0057812 A1 Feb. 21, 2019

Related U.S. Application Data

(60) Provisional application No. 62/545,495, filed on Aug. 15, 2017.

(51) Int. Cl.

| | |
|---|---|
| ***H01F 41/00*** | (2006.01) |
| ***H01F 41/12*** | (2006.01) |
| ***H01F 17/02*** | (2006.01) |
| ***H01F 17/04*** | (2006.01) |
| ***H01F 27/32*** | (2006.01) |

(Continued)

(52) U.S. Cl.

CPC ..... *H01F 41/12* (2013.01); *H01F 5/04* (2013.01); *H01F 5/06* (2013.01); *H01F 17/02* (2013.01); *H01F 17/04* (2013.01); *H01F 27/2823* (2013.01); *H01F 27/2828* (2013.01); *H01F 27/29* (2013.01); *H01F 27/32* (2013.01);

(Continued)

(58) Field of Classification Search

CPC .. H01F 17/02; H01F 27/2823; H01F 27/2828; H01F 27/29; H01F 27/325; H01F 41/066; H01F 41/0711; H01F 41/076; H01F 41/125; H01F 41/127; H01F 2005/043; H01F 5/06

See application file for complete search history.

(56) References Cited

U.S. PATENT DOCUMENTS 4,349,758 A * 9/1982 Grant, Jr. ..... H02K 5/148 310/68 A
5,317,300 A * 5/1994 Boesel ..... H01F 27/022 264/272.19

(Continued)

FOREIGN PATENT DOCUMENTS

JP 5244743 B2 7/2013

*Primary Examiner* — Emmanuel M Marcelo

(74) *Attorney, Agent, or Firm* — Laurence A. Greenberg; Werner H. Sterner; Ralph E. Locher

(57) ABSTRACT

A coil is produced by winding a wire that is clad with an electrical insulation so as to form a coil bundle of successive windings. The coil bundle has at least one first winding formed by a first end section of the wire and at least one second winding formed by a second end section of the wire. A portion of the electrical insulation of the at least one first winding is removed to expose a portion of the first end section of the wire for forming a first electrical contact of the coil, and a portion of the electrical insulation of the at least one second winding is removed to expose a portion of the second end section of the wire for forming said second electrical contact of the coil. There is also described a coil.

19 Claims, 9 Drawing Sheets

(51) Int. Cl.

| | |
|---|---|
| ***H01F 41/066*** | (2016.01) |
| ***H01F 27/28*** | (2006.01) |
| ***H01F 5/06*** | (2006.01) |
| ***H01F 41/076*** | (2016.01) |
| ***H01F 5/04*** | (2006.01) |
| ***H01F 27/29*** | (2006.01) |

(52) U.S. Cl.
CPC ..... *H01F 27/325* (2013.01); *H01F 41/066* (2016.01); *H01F 41/076* (2016.01)

(56) References Cited

U.S. PATENT DOCUMENTS

| | | | | |
|---|---|---|---|---|
| 8,860,982 | B2 | 10/2014 | Kanemitsu | |
| 2008/0007249 | A1 * | 1/2008 | Wilkerson ..... | G01R 15/181<br>324/127 |

* cited by examiner

INDUCTIVE COMMUNICATION COIL DESIGN

CROSS-REFERENCE TO RELATED APPLICATION

This application claims the benefit, under 35 U.S.C. § 119(e), of provisional patent application No. 62/545,495 filed Aug. 15, 2017; the prior application is herewith incorporated by reference in its entirety.

BACKGROUND OF THE INVENTION

Field of the Invention

The invention relates to a method for producing a coil as well as to a coil, particularly a coil, such as a communication coil, for an implantable medical device.

Standard air-core coils are terminated today through the use of human operators that manipulate the fine wire (40-52 gauge) for enamel stripping and manually solder the fine wire to termination pads or pins. This process is labor intensive and if improperly performed can lead to problems as a result of defect introduction during the wire stripping, termination application and soldering process.

Furthermore, due to the fine wire gauge used in communication coils for implantable devices, the current production method of inductive communication coils results in significant topological inconsistencies on the coil surface. Wires slip between layers, create peaks/valleys, and form unpredictable corners. This variance between coil samples impacts the effectiveness with which termination windows can be created on the face of the respective coil. An example of such a creation of termination windows is disclosed in published Japanese patent application JP 05-244743, in which windows are opened onto a coil for making the terminations.

Processes such as laser ablation have the possibility of penetrating between wires to deeper layers or grazing the rounded side of the coil. Once a soldering attempt is made to the window, it results in shorting between layers and a substantial impact on the efficiency of the coil. Similarly, mechanical ablation methods struggle with the accuracy with which they can target the surface of the wire resulting in coil damage and inconsistent connections.

SUMMARY OF THE INVENTION

The present invention discloses specific winding methods to enable such area contacts in an automatable fashion.

Based on the above, the problem to be solved by the present invention is to provide a coil as well as a method for producing a coil that is improved concerning at least one of the aspects describe above. Particularly, one object of the present invention is to provide a design and manufacturing method for coils (e.g., air-core coils) which can be automatically terminated.

With the foregoing and other objects in view there is provided, in accordance with the invention, a method for producing a coil, the method comprising:

winding a wire clad with an electrical insulation so as to form a coil bundle formed of successive windings, the coil bundle including at least one first winding formed by a first end section of the wire and at least one second winding formed by a second end section of the wire;

removing at least a portion of the electrical insulation of the at least one first winding to expose a portion of the first end section of the wire for forming a first electrical contact of the coil; and removing at least a portion of the electrical insulation of the at least one second winding to expose a portion of the second end section of the wire for forming a second electrical contact of the coil.

In other words, there is provided, in accordance with the invention, a method for producing a coil which includes the steps of: winding a wire covered with an electrical insulation (insulation cladding) so as to form a coil bundle comprised of successive windings, wherein the coil bundle comprises at least one first winding formed by a first end section of the wire and at least one second winding formed by a second end section of the wire, removing a portion of the electrical insulation of the at least one first winding to expose a portion of the first end section of the wire for forming a first electrical contact of the coil, and removing at least a portion of the electrical insulation of the at least one second winding to expose a portion of the second end section of the wire for forming a second electrical contact of the coil.

Particularly, the step of removing a portion of the electrical insulation of the at least one first and/or second winding is conducted without unwinding the respective first or second winding.

Particularly, the present invention is targeted at enabling highly controlled and automatable manufacturing and termination of fine wire coils used for inductive communications in implantable medical devices. Further, particularly, due to the fact that electrical insulation is removed from actual windings (namely the at least one first winding and the at least one second winding), the contacts of the coil provide in this way comprise a fixed position, and electrically contacting these contacts to make electrical contact with the coil can therefore be conducted in an automated fashion, which is not possible in case contact would have to be made to dangling free end of the wire protruding from the coil bundle.

Thus, particularly, the present invention proposes a design and manufacturing method for creating an (e.g. air-core) inductive communication coil which allows for automated methods for creation of the terminations. This enables a potential cost savings when compared to standard air-core coil designs due to lower labor costs.

Particularly, the method according to the invention allows presenting the surface of the coil in such a way that a predefined number of turns can be ablated, which alleviates the risk of accidentally ablating turns for which a connection is not desired. Consequently, the electrical and mechanical reliability of the coil is preserved.

According to an embodiment of the method according to the present invention, the coil bundle comprises a plurality of successive first windings formed by the first end section of the wire, wherein the step of removing a portion of the electrical insulation of the at least one first winding comprises removing a portion of the electrical insulation of one or several or all of the first windings to expose a portion of the first end section of the wire for forming a first electrical contact of the coil. Further, according to an embodiment, the coil bundle comprises a plurality of successive second windings formed by the second end section of the wire, wherein the step of removing a portion of the electrical insulation of the at least one second winding comprises removing a portion of the electrical insulation of one or several or all of the second windings to expose a portion of the second end section of the wire for forming a second electrical contact of the coil.

Herein, in all embodiments where the coil comprises at least one first winding, the coil may also comprise a plurality of successive first windings. Likewise, in all embodiments where the coil comprises at least one second winding, the coil may also comprise a plurality of successive second windings.

Further, according to an embodiment of the method according to the present invention, the wire is wound on a bobbin, so as to form said coil bundle.

Further, according to an embodiment of the method according to the present invention, the bobbin comprises fastening elements for holding the at least one first winding and the at least one second winding.

Further, according to another embodiment of the method according to the present invention, the bobbin comprises an annular (particularly cylindrical or tubular) wall member or is formed as such a wall member, which annular wall member extends along an axis (e.g. cylinder axis), wherein the annular wall member comprises a first and an opposing a second circumferential edge extending around said axis (e.g. in plane perpendicular said axis of the annular wall member), wherein the fastening elements for holding said at least one first winding are formed by two first recesses formed into the first edge as well as by two further first recesses formed into the second edge, and wherein the fastening elements for holding said at least one second winding are formed by two second recesses formed into the first edge as well as by two further second recesses formed into the second edge of the annular wall member.

Further, according to an embodiment of the method according to the present invention, the at least one first winding is connected to the at least one second winding via intermediary windings that are wound about said axis of the annular wall member around the annular wall member.

Particularly, the first end section of the wire is wound into said four first recesses to form said at least one first winding. Thereafter, the intermediary windings are wound on the annular wall member along a peripheral direction of the annular wall member. Finally, the second end section of the wire is wound into the second recesses to form the at least one second winding.

Further, according to an embodiment of the method according to the present invention, the at least one first winding is wound about a winding axis that is different from said axis of the annular wall member and/or wherein the at least one second winding is wound about a winding axis that is different from said axis of the annular wall member.

Further, according to an embodiment of the method according to the present invention, the winding axis of the at least one first winding and the winding axis of the at least one second winding extend perpendicular to said axis of the annular wall member (which axis of the annular wall member is the winding axis of those windings that connect the at least one first winding and the at least one second winding)

Further, according to an embodiment of the method according to the present invention, the bobbin is placed on an arbor that is rotated about a rotation axis to wind the wire on the bobbin, particularly on the annular wall member. Particularly, after winding of the wire on the bobbin, the bobbin can be removed from the arbor. Particularly, the arbor may comprise an axial core for receiving said annular wall member and optionally two opposing plates connected by the core.

Further, according to an embodiment of the method according to the present invention, the coil bundle is embedded into an electrically insulating material, e.g. by overmolding the material on the coil bundle, e.g. by arranging the coil bundle in a suitable mold that is filled with said material in order to embed the coil bundle into said material. This material would preferably be a polymer, such as Liquid Crystal Polymer, that can withstand the high temperatures (up to 260° C.) seen in convection reflow processing of PCBA's.

Further, according to an embodiment of the method according to the present invention, the step of removing a portion of the electrical insulation of the at least one first winding also comprises removing a portion of said insulating material covering the coil bundle so as to expose said portion of the wire of the first end section of the wire for forming said first electrical contact of the coil. In one example this insulation removal and planarization process for this embodiment could be Chemical Mechanical Polishing (CMP), such as is used broadly and commonly known in the technical field of semiconductor processing. Further, according to an embodiment, the step of removing a portion of the electrical insulation of the at least one second winding also comprises removing a portion of said insulating material covering the coil bundle so as to expose said portion of the second end section of the wire for forming said second electrical contact of the coil.

Particularly, according to an embodiment, said electrical contacts of the coil are arranged at a face side of the coil/coil bundle, which extends along an extension plane that runs perpendicular to said axis of the annular wall member of the bobbin.

Particularly, according to an embodiment, said electrical contacts are coated (particularly plated) with an electrically conducting material, e.g. a soldering material (e.g. Sn), that may be used in a subsequent (e.g. automated) soldering process.

Further, according to yet another embodiment of the method according to the present invention, for forming the coil bundle, the wire is wound on a core of an arbor, which arbor further comprises two opposing plates connected by the core, wherein after forming the coil bundle the latter is removed from the arbor.

Further, according to an embodiment of the method according to the present invention, said plurality of first windings forms several layers arranged on top of one another in a radial direction of the coil bundle, wherein each layer comprises several adjacent windings arranged side by side in an axial direction of the coil bundle. Particularly, the first windings only extend over a fraction of the length of the coil bundle in the axial direction of the coil bundle and in the radial direction of the coil bundle. Further, according to an embodiment of the method according to the present invention, said second windings form several layers arranged on top of one another in a radial direction of the coil bundle, wherein each layer comprises several adjacent windings arranged side by side in an axial direction of the coil bundle. Particularly, the second windings only extend over a fraction of the length of the coil bundle in the axial direction of the coil bundle and in the radial direction of the coil bundle.

Particularly, after the first windings have been wound onto the core, a plurality of first intermediary windings is wound onto the core adjacent to the first windings with respect to the axial direction of the core so that an outer surface of the first intermediary windings is flush with the first windings. Particularly, thereafter, a further plurality of second intermediary windings is wound onto the first windings and onto the first intermediary windings, which second intermediary windings extent over the whole core or coil bundle in the axial direction of the core or coil bundle. Thereafter, a plurality of third intermediary windings is wound onto the second intermediary windings, wherein the third intermediary windings do not extent over the whole length of the coil bundle or core in the axial direction of the coil bundle or core so as to leave a free space in which the second windings are wound onto the second intermediary windings so that eventually the second windings are flush with the third intermediary windings. In this way, the coil bundle comprises a cylindrical outer surface, as usual.

Such concentrated/localized pluralities of first and second windings are also called buffer windings. Particularly, the insulating material adjacent such first/second windings can be easily ablated since a short-circuit of the first or second windings merely affects the localized first or second windings (first or second end section of the wire). This means that the possible error in the coil characteristics introduced by an ablation error is known/adjustable beforehand.

Further, according to an embodiment of the method according to the present invention, the plurality of first windings form a region of a surface of the coil bundle. Further, according to an embodiment of the method, the plurality of second windings form a region of a surface of the coil bundle so that removing electrical insulation of said regions results in exposing a region of the first end section of the wire for forming a first electrical contact of the coil and a region of the second end section of the wire for forming a second electrical contact, which electrical contacts are configured for electrically contacting the coil bundle.

Further, according to an embodiment of the method according to the present invention, the plurality of second windings encompasses the plurality of first windings. One may also consider the first and second windings to be coplanar (concerning a plane running perpendicular to the axial direction of the core/coil bundle).

Further, according to an embodiment of the method according to the present invention, the first windings face the second windings in a radial direction of the coil bundle (or the core of the arbor).

Further, according to an embodiment of the method according to the present invention, said first windings and said second windings each form a protrusion of the coil bundle, which protrusions protrude in opposite directions from the coil bundle, particularly along the radial direction of the coil bundle.

Further, according to an embodiment of the method according to the present invention, the arbor may form at least one circumferential recess for receiving the first windings upon winding the wire onto the core of the arbor so that the first windings form a protrusion. Further, the second windings may be wound such that they also form a circumferential protrusion of the coil body. Said at least one recess may be formed in the core adjacent one of the plates.

According to a further aspect of the present invention, a coil is disclosed, that may be manufactured with the method according to the present invention.

With the above and other objects in view there is also provided, in accordance with the invention, an electromagnetic coil, comprising:

a wire clad with an electrical insulation and wound to form a coil bundle with a plurality of windings of the coil;

said coil bundle having a plurality of successive first windings formed by a first end section of said wire and a plurality of successive second windings formed by a second end section of said wire;

said wire of said first windings including an exposed region of said first windings for forming a first electrical contact of the coil; and said wire of said second windings including an exposed region of said second windings for forming a second electrical contact of the coil.

In other words, the coil comprises a wire covered with an electrical insulation and wound so as to form a coil bundle comprising a plurality of windings, which coil bundle comprises a plurality of successive first windings formed by a first end section of the wire and a plurality of successive second windings formed by a second end section of the wire, wherein the coil comprises an exposed region of the first end section of the wire for forming a first electrical contact of the coil, and wherein the coil comprises an exposed region of the second end section of the wire for forming a second electrical contact of the coil.

The exposed regions of the wire may be coated or plated with a further electrically conducting material.

According to a further embodiment of the coil according to the invention, the coil comprises a bobbin onto which the wire is wound.

Further, according to an embodiment of the coil according to the present invention, the bobbin comprises fastening elements for holding the at least one first winding and the at least one second winding.

Further, according to an embodiment of the coil according to the invention, the bobbin comprises an annular wall member or is formed as an annular wall member extending along an axis (e.g. a cylinder axis), wherein the annular wall member comprises a first and an opposing second circumferential edge extending around said axis (e.g. in plane perpendicular said axis of the annular wall member), wherein the fastening elements for holding said at least one first winding are formed by two first recesses formed into the first edge as well as by two further first recesses formed into the second edge, and wherein the fastening elements for holding said at least one second winding are formed by two second recesses formed into the first edge as well as by two further second recesses formed into the second edge. The wall member can also be the arbor of the bobbin.

Further, according to an embodiment of the coil according to the invention, the at least one first winding is connected to the at least one second winding via intermediary windings that are wound on the annular wall member in a peripheral direction of the annular wall member/bobbin.

Further, according to an embodiment of the coil according to the invention, the at least one first winding is wound about a winding axis that is different from said axis of the annular wall member and/or wherein the at least one second winding is wound about a winding axis that is different from said axis of the annular wall member.

Further, according to an embodiment of the coil according to the invention, the winding axis of the at least one first winding and the winding axis of the at least one second winding extend perpendicular to said axis of the annular wall member, respectively (which axis of the annular wall member is the winding axis of those windings that connect the at least one first winding and the at least one second winding).

Further, particularly, the winding axes of the first and of the second windings extend parallel with respect to each other.

Further, according to an embodiment of the coil according to the invention, the coil bundle is further covered by an electrically insulating material which does not cover said exposed regions of the wire. Particularly in the method according to the present invention said exposed regions are generated by partially removing said insulating material and the electrical insulation from a region of the first end section and from a region of the second end section of the wire.

Particularly according to an embodiment of the coil according to the invention, said exposed regions are arranged on a face side of the coil which may extend perpendicular to the axial direction of the coil bundle.

Further, according to yet another embodiment of the coil according to the present invention, said first windings form several layers arranged on top of one another in a radial direction of the coil bundle, wherein each layer comprises several adjacent windings arranged side by side in an axial direction of the coil bundle, and wherein the first windings only extend over a fraction of the length of the coil bundle in the axial direction of the coil bundle and in the radial direction of the coil bundle, and/or wherein said second windings form several layers arranged on top of one another in a radial direction of the coil bundle, wherein each layer comprises several adjacent windings arranged side by side in an axial direction of the coil bundle, and wherein the second windings only extend over a fraction of the length of the coil bundle in the axial direction of the coil bundle and in the radial direction of the coil bundle.

Further, according to an embodiment of the coil according to the present invention, the first windings form a region of a surface of the coil bundle. Further, according to an embodiment, the second windings form a region of a surface of the coil bundle, too, so that removing electrical insulation of said regions results in exposing wire of the first and second windings for forming electrical contacts for electrically contacting the coil.

Further, according to an embodiment of the coil according to the present invention, the second windings encompass the first windings.

Further, according to an embodiment of the coil according to the present invention, the first windings face the second windings in a radial direction of the coil bundle.

Further, according to an embodiment of the coil according to the present invention, said first windings and said second windings each form a protrusion of the coil bundle, which protrusions protrude in opposite directions from the remaining portion of the coil bundle, particularly along the radial direction of the coil bundle, respectively.

Other features which are considered as characteristic for the invention are set forth in the appended claims.

Although the invention is illustrated and described herein as embodied in an inductive communication coil design, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
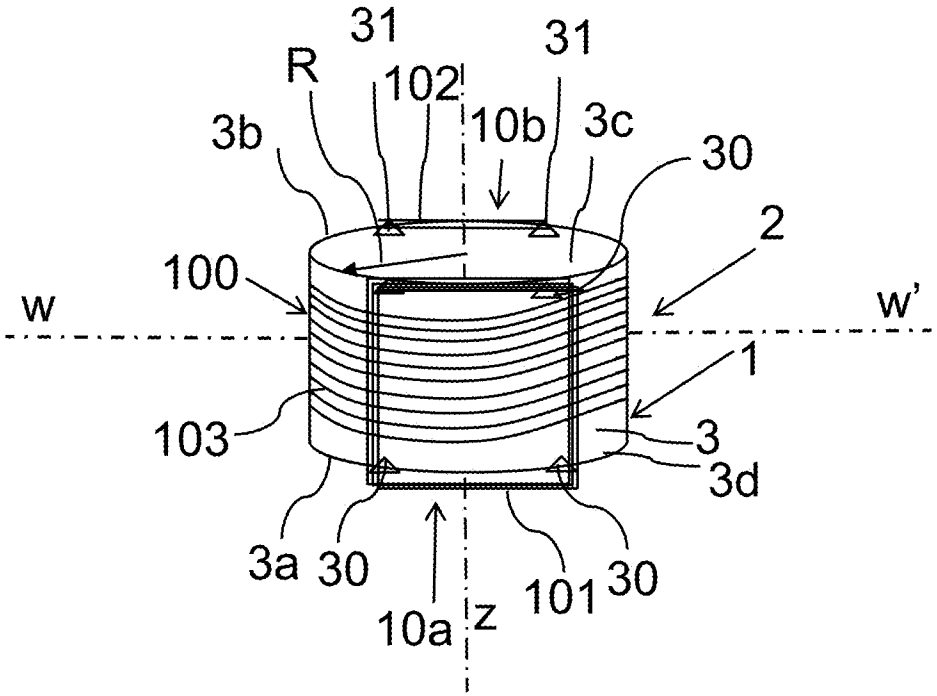
FIG. 2 shows a schematic view of a coil bundle wound on a bobbin of a coil according to the present invention.

Referring now once more to the figures of the drawing in detail and, particularly, to FIG. 2 thereof, there is shown a coil bundle 2 arranged on a bobbin 3 of a coil 1 according to the present invention. For manufacturing such a coil 1, a wire 10 that comprises an electrical insulation 11 is wound (here, e.g., on a bobbin 3) so as to form a coil bundle 2 comprised of successive windings 100.

Figure 1:
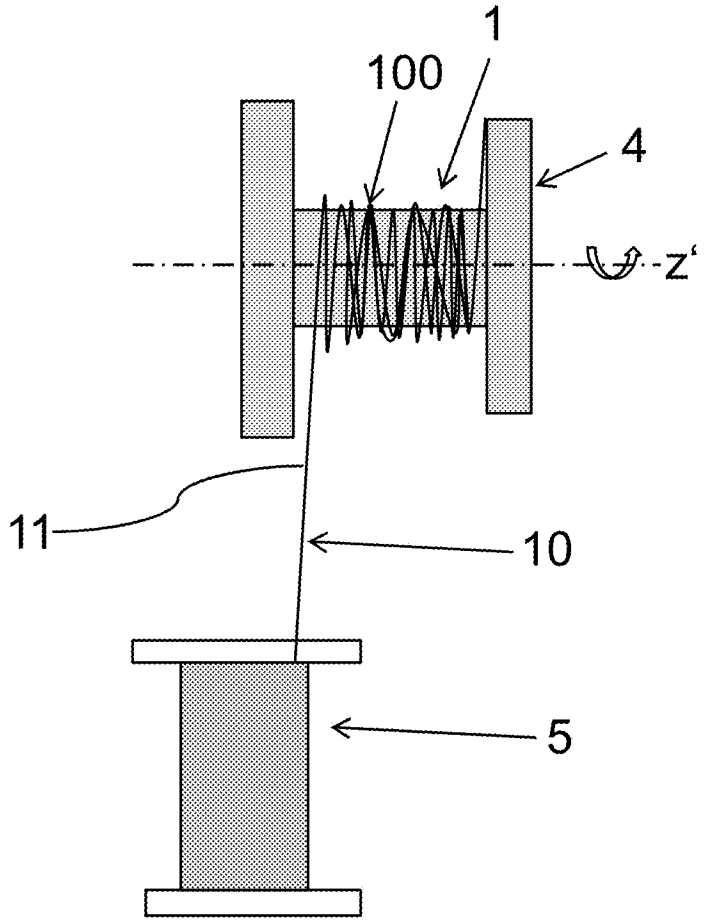
FIG. 1 shows a way of winding a wire from a spool onto an arbor for forming a coil bundle.

For winding of the coil bundle 2, the bobbin 3 can be placed on an arbor 4 that is rotated about a rotation axis z' (e.g. similar to FIG. 1) to wind the wire 10 on the bobbin 3. After winding of the wire 10 onto the bobbin 3, the bobbin 3 can be removed from the arbor 4.

The coil bundle 2 comprises at least one first winding 101 (here a plurality of first windings 101) formed by a first end section 10*a* of the wire 10 and at least one second winding 102 (here a plurality of second windings 102) formed by a second end section 10*b* of the wire 10. A portion 11*a* of the electrical insulation 11 of the first windings 101 is removed so as to expose a portion of the first end section 10*a* of the wire 10 for forming a first electrical contact 111 of the coil 1 (cf. FIG. 6). Likewise, a portion 11*b* of the electrical insulation 11 of the second windings 102 is removed so as to expose a portion of the second end section 10*b* of the wire 10 for forming a second electrical contact 112 of the coil 1 (cf. also FIG. 6). Ways of forming the electrical contacts 111, 112 will be described in more detail below.

The first windings 101 are retained by four first recesses 30 that are formed into opposing circumferential edges 3*a*, 3*b* of the annular (e.g. tubular) wall member 3*d*, which forms bobbin 3. Particularly, two first recesses 30 are formed into the first edge 3*a* and two further first recesses 30 are formed into the second edge 3*b* so that the four recesses 30 are located on the corners of a virtual rectangle. The first end section 10*a* of the wire 30 is wound into these first recesses 30 so that several successive first windings 101 are generated that will later be used for forming a first electrical contact 111 of the coil 1. After winding of the first windings 101, a plurality of intermediary windings 103 is wound in a peripheral direction of the bobbin 3 onto the bobbin 3. These intermediary windings 103 surround the axis z of the annular wall member 3*d*/bobbin 3. After winding of these intermediary windings 103, a plurality of second windings 102 is generated. Also here, the second windings 102 are retained by four second recesses 31 that are formed into the two edges 3*a*, 3*b* of the wall member 3*d*. Particularly, again, two second recesses 31 are formed into the first edge 3*a* and two further second recesses 31 are formed into the second edge 3*b* so that the four second recesses 30 are located on the corners of a virtual rectangle. The second end section 10*b* of the wire 10 is now wound into these second recesses 31 so that several successive second windings 102 are generated that will later be used for forming a second electrical contact 112 of the coil 1.

Further, the successive first windings 101 are wound about a winding axis w that particularly aligns with the winding axis w' of the second windings 102, wherein both winding axes w, w' particularly run perpendicular to said axis z of the annular wall member 3*d*, which axis z of the annular wall member 3*d* is the winding axis of those intermediary windings 103 that connect the first windings 101 to the second windings 102.

Figure 4:
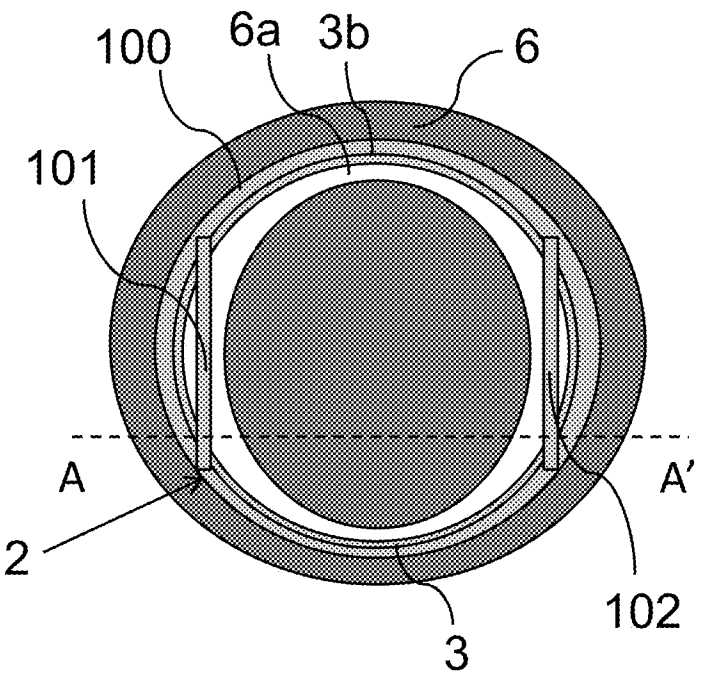
FIG. 4 shows a top view of the mold shown in FIG. 3 and of a coil bundle/bobbin arranged therein.
Figure 3:
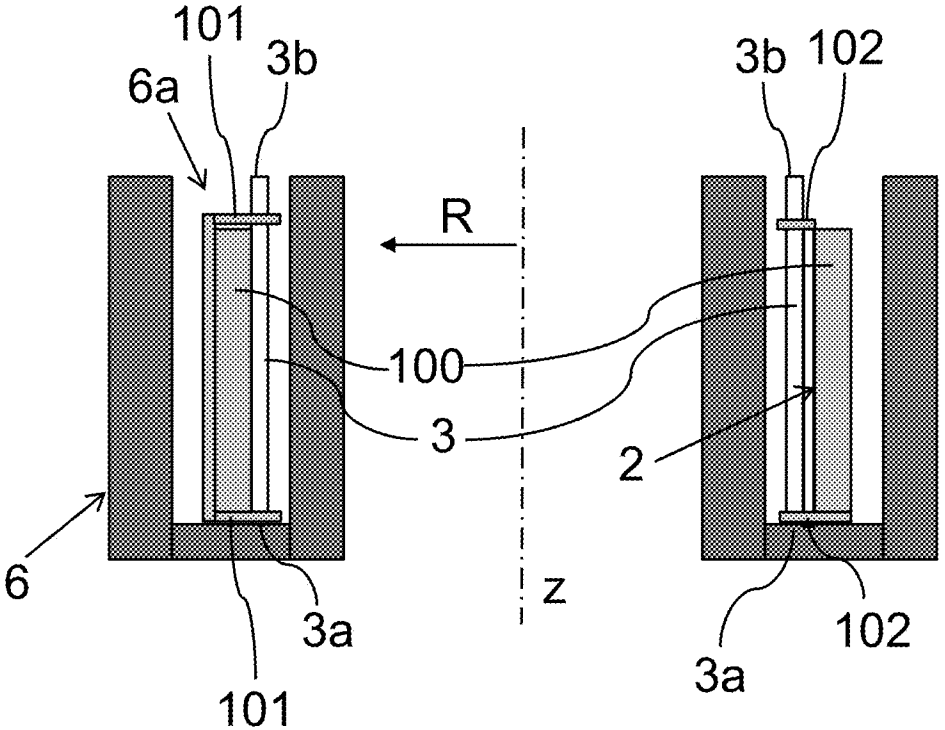
FIG. 3 shows the coil bundle and bobbin as shown in FIG. 2 arranged in a mold for embedding the coil bundle in an electrically insulating material.
Figure 5:
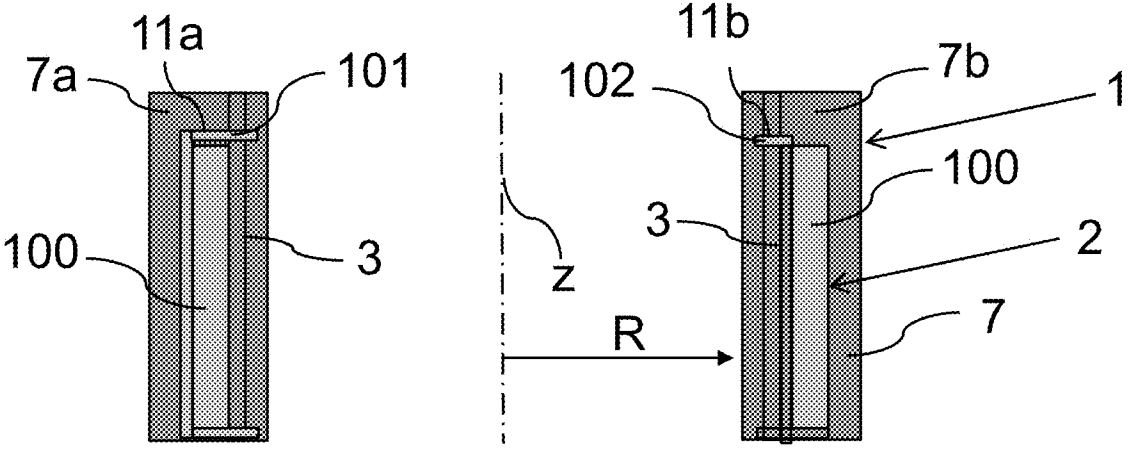
FIG. 5 shows the coil bundle and bobbin embedded in said insulating material using the mold shown in FIG. 4.

Preferably, the coil bundle 2 comprising the bobbin 3, the first and second windings 101, 102 as well as the further connecting/intermediary windings 103 is overmolded with an electrically insulating material 7 (cf. FIG. 5) by placing the coil bundle 2 into the cavity 6*a* of a mold 6 as shown in FIGS. 3 and 4. The cavity 6*a* is then filled with the material 7 so as to form a coil bundle 2 embedded in the material 7, as shown in FIG. 5.

Figure 6:
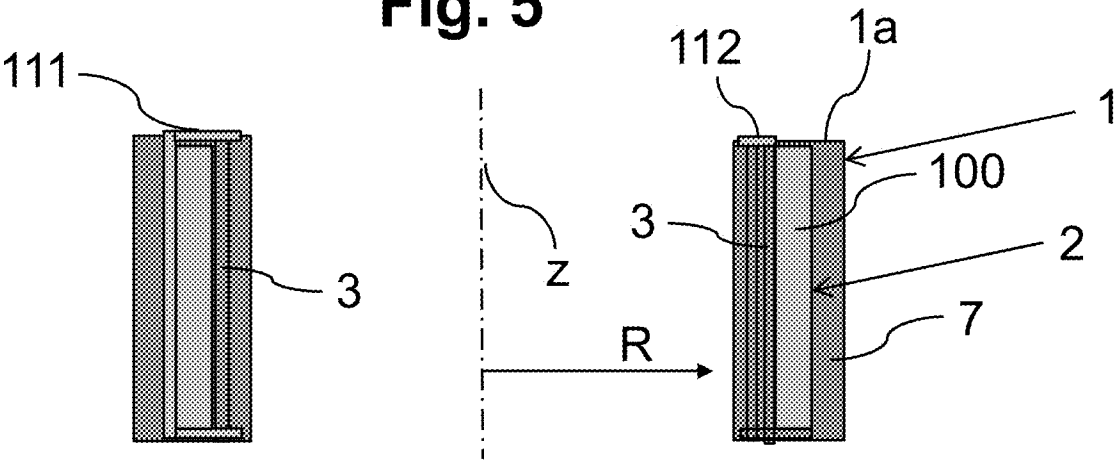
FIG. 6 shows the finished coil after removing of a portion of the insulating material and electrical insulation of the first and second windings of the coil bundle for forming electrical contacts of the coil.

In order to provide electrical contacts 111, 112 of the coil 11 connected to the first and second end section 10*a*, 10*b* of the wire 10, a portion 7*a*, 7*b* of said material 7 as well as an adjacent portion 11*a*, 11*b* of the electrical insulation 11 of the wire 10 is removed (e.g. by laser ablation or some other suitable technique) so as to expose a region 111 of the first end section 10*a* of the wire 10 (i.e. of the first windings 101) as well as a region 112 of the second end section 10*b* of the wire 10 (i.e., of the second windings 102), which regions 111, 112 form contacts 111, 112 for electrically contacting the windings of the coil bundle 2 (cf. FIG. 6).

Particularly, electrically insulating material 11*a*, 11*b*, 7*a*, 7*b* is removed from a face side of the coil 1, so that said electrical contacts 111, 112 are arranged on a face side 1*a* of the coil 1 that extends perpendicular to the axis z of the bobbin 3/coil bundle 2.

Figure 7:
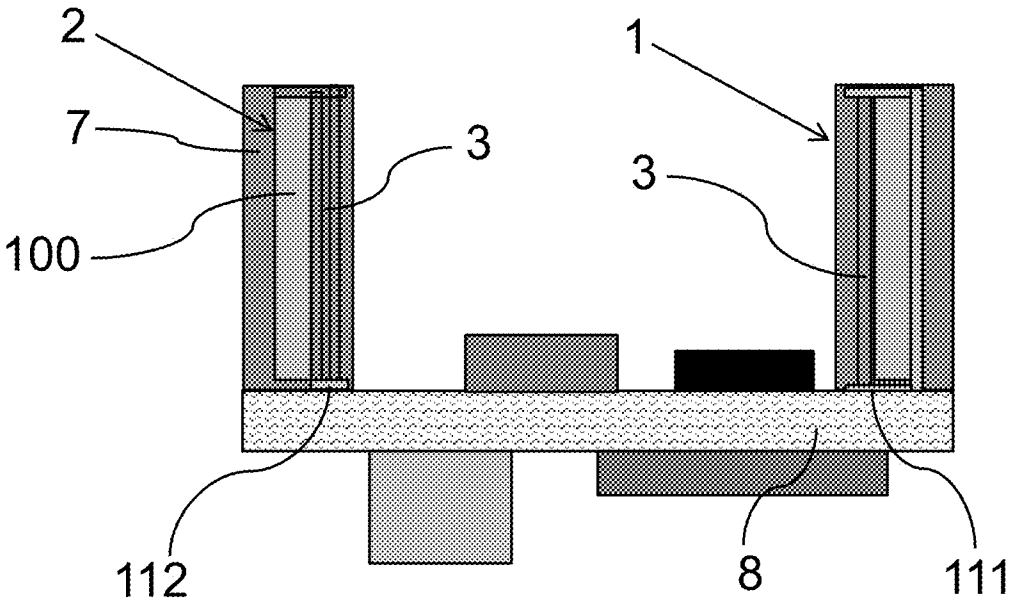
FIG. 7 shows the coil according to FIG. 6 with its electrical contacts soldered to a printed circuit board.

Particularly, said contacts 111, 112 may be coated (particularly plated) with an electrically conducting material, e.g. a soldering material (e.g. Sn), that may be used in a subsequent (e.g. automated) soldering process in which the coil 1 is soldered with its contacts 111, 112 to a printed circuit board 8 as shown in FIG. 7.

The way in which the first and second windings 101, 102 are arranged with respect to the connecting further windings 103 of the coil 1 guaranties that the removal of insulating material/electrical insulation of the wire 10 at end sections 10*a* and 10*b* merely affects the first and second windings 101, 102 thus possible short-circuits upon contacting contacts 111 and 112 (e.g. by soldering or during ablation) are limited to the first and second windings and do not affect the successive windings 103 wound in the peripheral direction of the bobbin 3 which are responsible for achieving the desired electrical properties of the coil 1.

Figure 10:
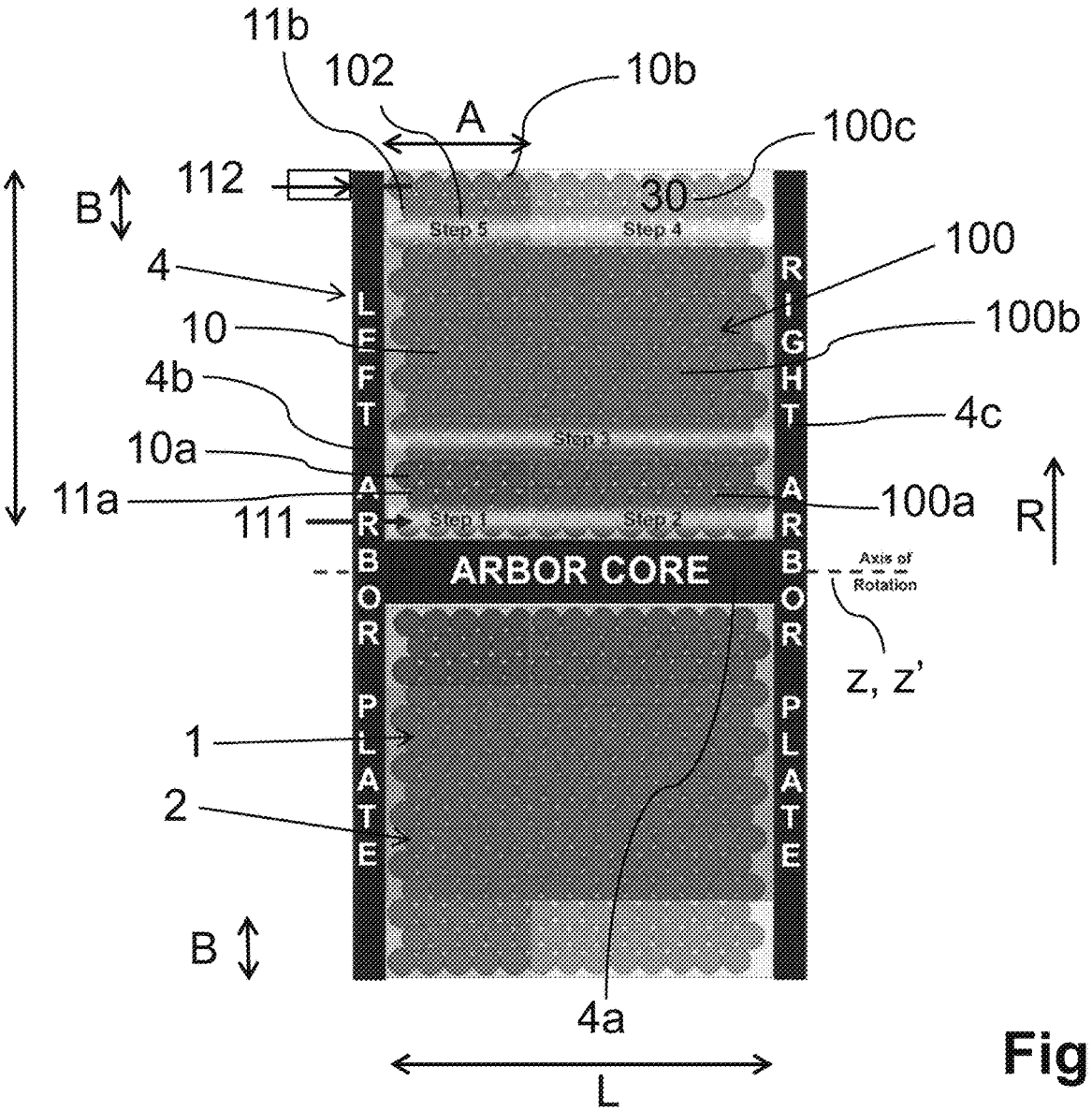
FIG. 10 shows a cross section of a coil according to the present invention wherein first and second windings of the coil bundle are generated such that ablation of portions of electrical insulation of first and second windings can be conducted with a low risk of rendering a high number of windings useless concerning operation of the coil due to short circuits.
Figure 11:
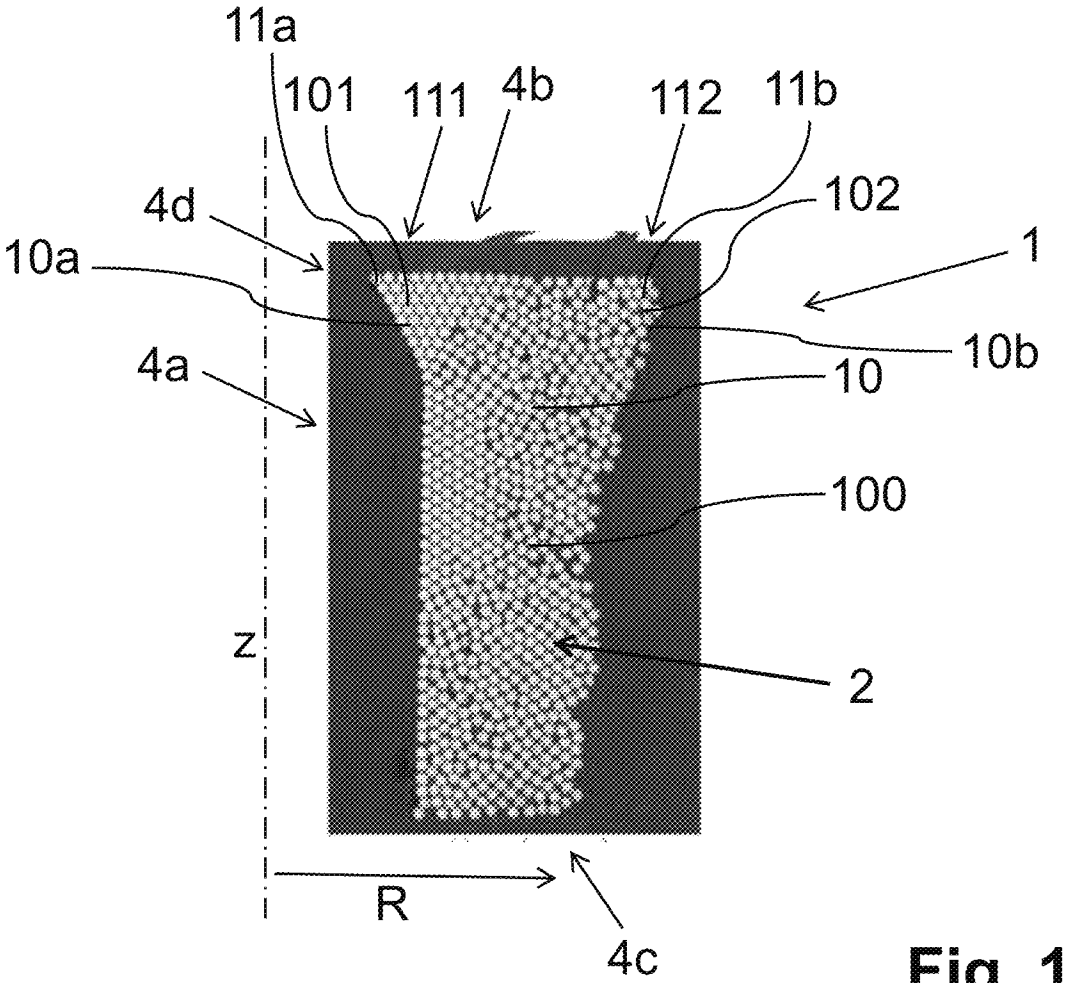
FIG. 11 shows a cross-section of another embodiment of a coil according to the present invention.

Further embodiments of the present invention are shown in FIGS. 10 and 11.

Figure 8:
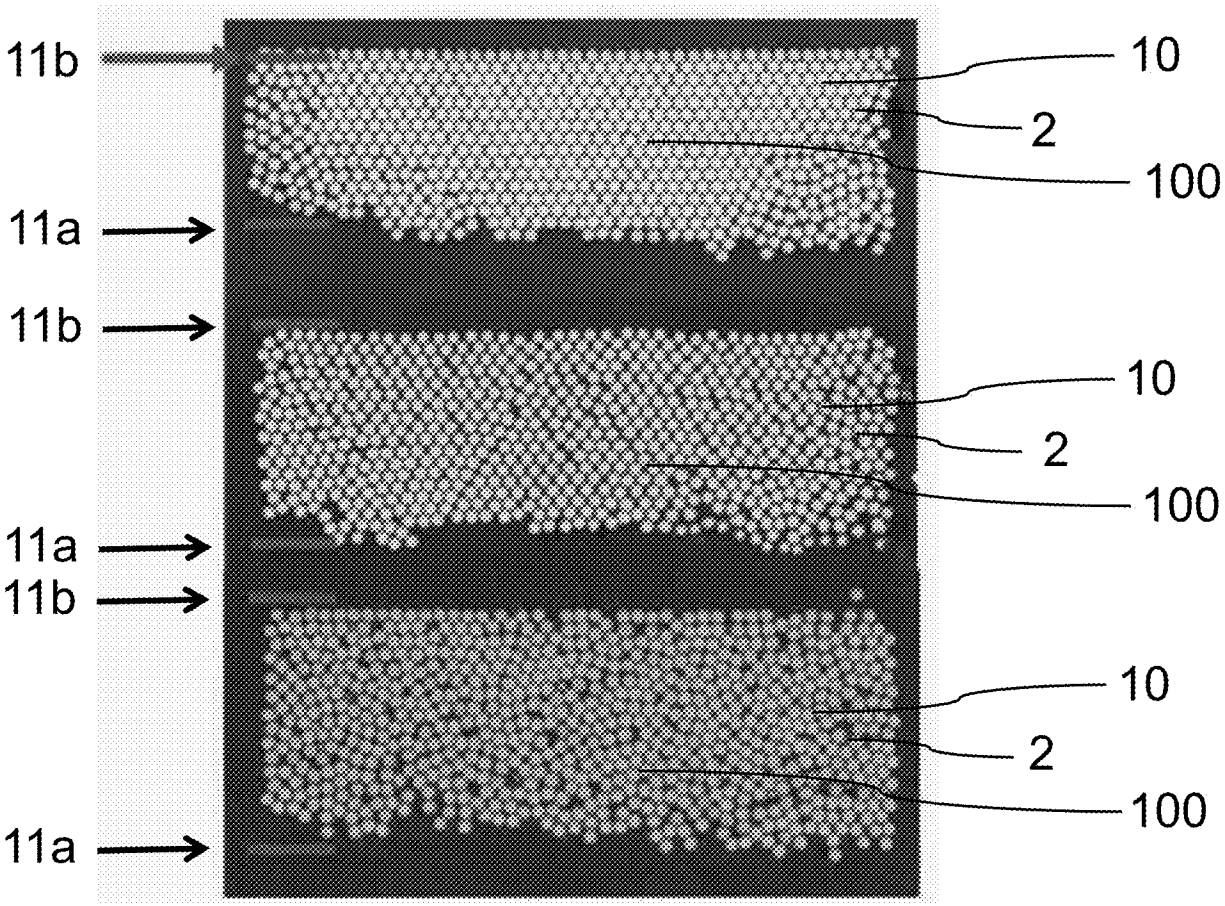
FIG. 8 shows three different cross-sections of air-core coil bundles as well as a corresponding regions in which the electrical insulation of the respective coil bundle is to be ablated in order to electrically contact the coil bundle.

In this regard, FIG. 8 shows several generic cross sections of coil bundles 2 comprising windings 100 of a wire 10 and proposed window termination locations 11*a*, 11*b*, i.e. regions, where electrical insulation 11 of the wire 10 is to be removed in order to expose the wire 10 for forming two electrical contacts of the respective coil bundle 2 for electrically contacting the respective coil bundle 2.

Figure 9:
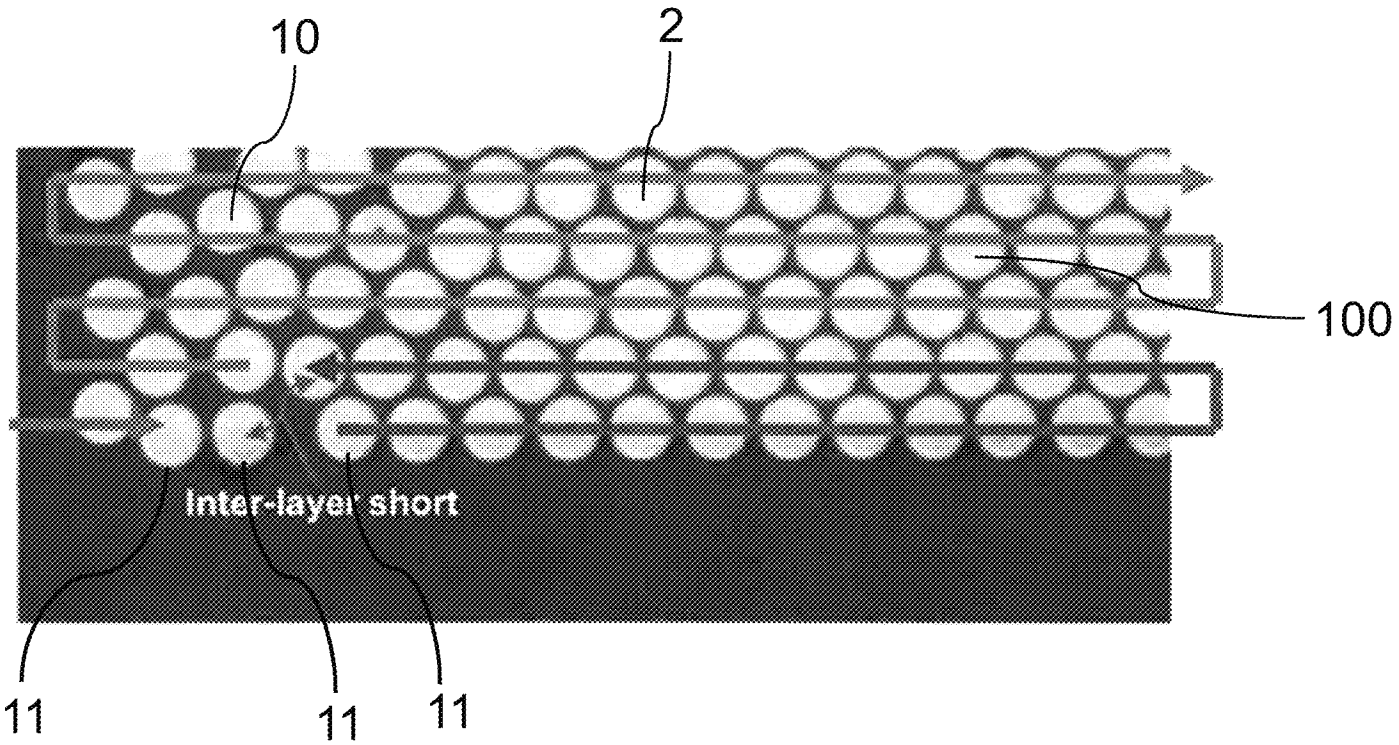
FIG. 9 shows a cross section of a coil bundle in order to indicate difficulties occurring when ablating electrical insulation of wire sections, which ablation may cause an interlayer short of the coil bundle thus rendering a significant number of windings useless concerning operation of the coil.

Due to the large variability in the inside and outside surface of the coil bundle, top and bottom respectively, it is apparent that wire sections from multiple layers of the coil bundle 2 could potentially be ablated and subsequently shorted to each other. When an inter-layer short develops; all the turns within their respective layers located between the two wires form a shorted loop and cease to contribute to the operation of the coil 2 as shown in FIG. 9. Additionally, this shorted loop can have a parasitic effect on the coil inductance further reducing its communication distance.

Current winding processes have a margin of error that leads to inconsistencies in the exact position of wires within a layer. The result is that gaps are formed within the coil bundle 2 which allow wires to slip between layers. The use of insulation removal processes, such as laser ablation stripping, can also penetrate through these gaps and thereby reach inner layers in the coil. However, these inconsistencies typically do not expose wires more than two layers deep from either side with the infrequent third layer being exposed to possible ablation.

Thus, by optimizing the way layers are placed during the winding process through the use of buffer turns, the impact of inter-layer shorting can be strongly mitigated. As shown in FIG. 10 such a coil 1 can be manufactured using a winding arbor 4 that consists of two plates 4*a*, 4*b* to guide the wire 10 and a core 4*a* that the wire 10 wraps around. During the winding process the arbor 4 spins around the cores axis z' as a wire guide shifts between the two plates 4*a*, 4*b* laying the wire 10 in layers on the surface of the core 4*a*.

Buffer turns, here denoted as first windings 101 and second windings 102, are used to create concentrated layers of wire 10 below desired window ablation locations by traversing a predefined portion of the winding arbor 4 at the start and end of the winding process rather than the arbor's 4 entire width.

By containing the initial and final turns, i.e. the first windings 101 and the second windings 102, where the respective window/contact 111, 112 will be created, the total number of shorted turns generated by an inter-layer short can be drastically reduced.

One exemplary buffer winding technique, shown in FIG. 10, is the so-called 2i-buffer coil.

In this configuration the winder lays wire 10 through a set progression of steps 1, 2, 3, 4, and 5. By doing so, the first windings 101 (initial turns) and the second windings 102 (final turns) are concentrated in coplanar corners of the coil bundle 2. In other words, the second windings 102 encompass the first windings 101.

Thus, an inter-layer short occurring within these corners, up to three layers deep, is contained to the size of the buffer. One advantage of the 2i buffer configuration is the use of steps 2 and 4 to preserve the geometry of the coil bundle 2.

Here, after having formed the first windings 101 out of the first end section 10 of the wire 10, which first windings 101 only extend in the axial direction z of the coil bundle 2 over a part A of the length of the coil bundle 2 in the axial direction z, as well as merely over a part B of the width D of the coil bundle 2 in the radial direction R of the coil bundle 2, first intermediary windings 100*a* are laid down which fill up the neighboring space in the axial direction z, followed by second intermediary windings 100*b* formed in step 3 which extend over the entire axial length L of the coil bundle 2. Finally, after having formed third intermediary windings 100*c* in step 4, the concentrated second windings 102 are formed out of the second end section 10*b* of the wire 10 in step 5.

The size of the respective buffer (first/second windings 101, 102) can be easily manipulated to accommodate the maximum error of the ablation technique.

Furthermore, in the case that no inter-layer shorts are developed, the remaining insulated portion of the first and second windings 101, 102 remains a part of the functional coil 1.

An alternate buffer winding technique is the T-buffer coil, shown in FIG. 11. This configuration shares the advantages of the 2i-buffer configuration, such as its protective layering, adaptable buffer size, and recycling of un-shorted buffer turns (first and second windings 101, 102) into the operational coil 1. This winding technique may use an arbor 4 with plates 4*b*, 4*c* connected by a core 4*a* that includes a recess 4*d*, here adjacent plate 4*b*.

By laying the first windings 101 into this recess 4*d* this inside buffer section 101 can be made to protrude from the surface of the final coil bundle 2. Similarly, the final turns 102, i.e. the second windings 102, can be concentrated at the top of the coil bundle 2 at the opposite surface of the coil bundle 2 forming a similar proud buffer on the outside coil bundle face. An electrical contact 111 for contacting the first windings 101 can then be manufactured by removing a corresponding portion 11*a* of the electrical insulation of the first end section 10*a* of the wire 10 to expose a corresponding portion of the wire 10. Likewise a further electrical contact 112 for contacting the second windings 102 can then be manufactured by removing a corresponding portion 11*b* of the electrical insulation 11 of the second end section 10*b* of the wire 10 to expose a corresponding portion of the wire 10. By creating protruding buffer zones mechanical window generation techniques become more feasible (e.g. grinding or powder blasting).

Embedding supplementary buffer turns, here first and second windings 101, 102 into coils 1 is both quick and inexpensive to implement through existing machinery. Furthermore, by mitigating the impact of inter-layer shorting rather than preventing its occurrence, the method according to the present invention promises strong reliability with flexible methods of application.

It will be apparent to those skilled in the art that numerous modifications and variations of the described examples and embodiments are possible in light of the above teaching. The disclosed examples and embodiments are presented for purposes of illustration only. Other alternate embodiments may include some or all of the features disclosed herein. Therefore, it is the intent to cover all such modifications and alternate embodiments as may come within the true scope of this invention.

The invention claimed is:

1. A method for producing a coil, the method comprising:

winding a wire clad with an electrical insulation so as to form a coil bundle formed of successive windings, the coil bundle including at least one first winding formed by a first end section of the wire and at least one second winding formed by a second end section of the wire;

removing at least a portion of the electrical insulation of the at least one first winding to expose a portion of the first end section of the wire for forming a first electrical contact of the coil; and removing at least a portion of the electrical insulation of the at least one second winding to expose a portion of the second end section of the wire for forming a second electrical contact of the coil.

2. The method according to claim 1, wherein:

the coil bundle comprises a plurality of successive first windings formed by the first end section of the wire; and the step of removing at least a portion of the electrical insulation of the at least one first winding comprises removing at least a portion of the electrical insulation of one or of several first windings to expose a portion of the first end section of the wire for forming the first electrical contact of the coil;

and/or the coil bundle comprises a plurality of successive second windings formed by the second end section of the wire; and the step of removing at least a portion of the electrical insulation of the at least one second winding comprises removing at least a portion of the electrical insulation of one or of several second windings to expose a portion of the second end section of the wire for forming the second electrical contact of the coil.

3. The method according to claim 2, wherein:

the first windings form a plurality of layers arranged on top of one another in a radial direction of the coil bundle, wherein each layer comprises a plurality of adjacent windings arranged side by side in an axial direction of the coil bundle, and wherein the first windings only extend over a part of a length of the coil bundle in the axial direction of the coil bundle and only extend over a part of a width of the coil bundle in the radial direction of the coil bundle;

and/or the second windings form a plurality of layers arranged on top of one another in the radial direction of the coil bundle, wherein each layer comprises a plurality of adjacent windings arranged side by side in the axial direction of the coil bundle, and wherein the second windings only extend over a part of the length of the coil bundle in the axial direction of the coil bundle and only extend over a part of the width of the coil bundle in the radial direction of the coil bundle.

4. The method according to claim 2, wherein the first windings form a region of an outer surface of the coil bundle, and/or wherein the second windings form a region of the outer surface of the coil bundle.

5. The method according to claim 2, wherein the second windings encompass the first windings.

6. The method according to claim 2, wherein the first windings face the second windings in an axial direction of the coil bundle.

7. The method according to claim 6, wherein the first windings and the second windings each form a protrusion of the coil bundle, which protrusions protrude in opposite directions from the coil bundle.

8. The method according to claim 7, wherein the protrusions project in a radial direction of the coil bundle.

9. The method according to claim 1, which comprises winding the wire on a bobbin.

10. The method according to claim 9, wherein the bobbin comprises fastening elements for holding the at least one first winding and the at least one second winding.

11. The method according to claim 10, wherein:

the bobbin comprises an annular wall member extending along an axis, the annular wall member is formed with a first and a second circumferential edge extending around the axis;

the fastening elements for holding the at least one first winding are two first recesses formed into the first circumferential edge and two first recesses formed into the second circumferential edge;

the first end section of the wire is wound into the four first recesses to form the at least one first winding; and the fastening elements for holding the at least one second winding are two second recesses formed into the first circumferential edge and two further second recesses formed into the second circumferential edge of the annular member; and the second end section of the wire is wound into the four second recesses to form said at least one second winding.

12. The method according to claim 11, wherein the at least one first winding is connected to the at least one second winding via intermediary windings that are wound about the axis of the annular wall member onto the annular wall member after winding of the at least one first winding and before winding of the at least one second winding.

13. The method according to claim 11, wherein the at least one first winding is wound about a winding axis that is different from the axis of the annular wall member and/or wherein the at least one second winding is wound about a winding axis that is different from the axis of the annular wall member.

14. The method according to claim 13, wherein the winding axis of the at least one first winding and the winding axis of the at least one second winding extend perpendicular to the axis of the annular wall member.

15. The method according to claim 1, which comprises embedding the coil bundle into an electrically insulating material.

16. The method according to claim 15, wherein:

the step of removing a portion of the electrical insulation of the at least one first winding also comprises removing a portion of the insulating material so as to expose the portion of the first end section of the wire for forming the first electrical contact of the coil;

and/or the step of removing a portion of the electrical insulation of the at least one second winding also comprises removing a portion of the insulating material so as to expose the portion of the second end section of the wire for forming the second electrical contact of the coil.

17. The method according to claim 1, which comprises forming the coil bundle by winding the wire on a core of an arbor, the arbor further comprising two opposing plates connected by the core, and, after the coil bundle has been formed, removing the coil bundle from the arbor.

18. The method according to claim 17, wherein the arbor is formed with at least one recess for receiving the first windings so that the first windings form a protrusion of the coil bundle upon winding the wire into the recess.

19. The method according to claim 1, which comprises forming the coil bundle by winding the wire on a core of an arbor, the arbor further comprising two opposing plates connected by the core, and, after the coil bundle has been formed, removing the coil bundle from the arbor, and wherein:

the first windings form a plurality of layers arranged on top of one another in a radial direction of the coil bundle, wherein each layer comprises a plurality of adjacent windings arranged side by side in an axial direction of the coil bundle, and wherein the first windings only extend over a part of a length of the coil bundle in the axial direction of the coil bundle and only extend over a part of a width of the coil bundle in the radial direction of the coil bundle;

the second windings form a plurality of layers arranged on top of one another in the radial direction of the coil bundle, wherein each layer comprises a plurality of adjacent windings arranged side by side in the axial direction of the coil bundle, and wherein the second windings only extend over a part of the length of the coil bundle in the axial direction of the coil bundle and only extend over a part of the width of the coil bundle in the radial direction of the coil bundle;

the first windings form a region of an outer surface of the coil bundle, and/or wherein the second windings form a region of the outer surface of the coil bundle; and the first windings face the second windings in an axial direction of the coil bundle.

* * * * *